US011152179B2

(12) United States Patent
Schmoelzer et al.

(10) Patent No.: US 11,152,179 B2
(45) Date of Patent: Oct. 19, 2021

(54) LOW VOLTAGE CIRCUIT BREAKER

(71) Applicant: ABB Schweiz AG, Baden (CH)

(72) Inventors: Thomas Schmoelzer, Essen (DE); Markus Hoidis, Niederrohrdorf (CH); Enrico Dell Oro, Milan (IT); Chiara Cantini, Albino (IT); Antonello Antoniazzi, Milan (IT); Reinhard Simon, Baden-Daettwil (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/937,011

(22) Filed: Mar. 27, 2018

(65) Prior Publication Data

US 2018/0286620 A1 Oct. 4, 2018

(30) Foreign Application Priority Data

Mar. 27, 2017 (LU) ..... LU100148

(51) Int. Cl.
*H01H 1/021* (2006.01)
*H01H 71/66* (2006.01)
(Continued)

(52) U.S. Cl.
CPC ..... *H01H 71/66* (2013.01); *C22C 5/06* (2013.01); *H01H 1/021* (2013.01); *H01H 1/0233* (2013.01); *H01H 3/22* (2013.01); *H01H 71/0264* (2013.01); *H01H 73/04* (2013.01); *B22F 7/02* (2013.01); *C22C 29/08* (2013.01);
(Continued)

(58) Field of Classification Search
CPC ..... H01H 1/021; H01H 1/023
See application file for complete search history.

(56) References Cited

U.S. PATENT DOCUMENTS 6,689,979 B1 2/2004 Bach et al.
9,368,301 B2 * 6/2016 Campbell ..... B22F 1/00
(Continued)

FOREIGN PATENT DOCUMENTS

EP 0031159 A1 7/1981
EP 2838096 A1 10/2015
(Continued)

OTHER PUBLICATIONS

Luxembourg Patent Office, Search Report issued in corresponding Application No. LU100148, dated Feb. 20, 2013, 7 pp.
(Continued)

*Primary Examiner* — Felix O Figueroa
(74) *Attorney, Agent, or Firm* — Greenberg Traurig, LLP

(57) ABSTRACT

A low voltage circuit breaker is provided. The low voltage circuit breaker includes a contact system with a first contact and a second contact that are electrically connectable and disconnectable relative to one another. The first contact includes a body having a first layer and a second layer, wherein the first layer is arranged on the second layer and is configured to come in contact with the second contact for providing the electrical connection with the second contact. The first layer has a first material composition having an Ag content that is higher than an Ag content of a second material composition of the second layer. Further, the first material composition has a WC content that is lower than a WC content of the second material composition.

20 Claims, 3 Drawing Sheets

(51) Int. Cl.

| | |
|---|---|
| ***C22C 5/06*** | (2006.01) |
| ***H01H 1/0233*** | (2006.01) |
| ***H01H 3/22*** | (2006.01) |
| ***H01H 71/02*** | (2006.01) |
| ***H01H 73/04*** | (2006.01) |
| *B22F 7/02* | (2006.01) |
| *C22C 29/08* | (2006.01) |
| *C22C 32/00* | (2006.01) |
| *H01H 37/32* | (2006.01) |
| *H01H 71/04* | (2006.01) |

(52) U.S. Cl.
CPC ..... *C22C 32/0052* (2013.01); *H01H 37/32* (2013.01); *H01H 2071/046* (2013.01); *H01H 2071/665* (2013.01)

(56) References Cited

U.S. PATENT DOCUMENTS

| | | | | |
|---|---|---|---|---|
| 2015/0048054 | A1* | 2/2015 | Karkada | H01H 1/0233 218/146 |
| 2016/0141124 | A1* | 5/2016 | Pohle | H01H 11/04 419/18 |
| 2018/0174769 | A1* | 6/2018 | Ajdelsztajn | H01H 1/021 |

FOREIGN PATENT DOCUMENTS

| | | | |
|---|---|---|---|
| EP | 2838096 | B1 | 7/2017 |
| JP | 2003-504801 | A | 2/2003 |
| WO | 2014/136617 | A1 | 9/2014 |
| WO | 2015158373 | A1 | 10/2015 |

OTHER PUBLICATIONS

Intellectual Property India, Examination Report issued in corresponding Indian application No. 201844010617, dated Jan. 9, 2020, 5 pp.

* cited by examiner

LOW VOLTAGE CIRCUIT BREAKER

FIELD

The present application relates to a low voltage circuit breaker, and specifically to a low voltage circuit breaker having a bi-layered moving contact.

BACKGROUND

Low voltage circuit breakers are common in domestic, commercial and industrial applications. A low voltage circuit breaker can be an automatically operated electrical switch, specifically designed and configured to protect an electrical circuit from damage caused by excess current, typically resulting from an overload or short circuit. Its basic function is to interrupt current flow after a fault is detected. Unlike a fuse, which operates once and then must be replaced, a circuit breaker can be reset (either manually or automatically) to resume normal operation.

A low voltage circuit breaker normally includes a contact system having two contacts that are electrically connectable and disconnectable relative to one another. Contacts, particularly the moving contacts, in low voltage circuit breakers are normally made of an AgWC material that includes, in mass-%, an Ag content of 60% and a WC content of 40%. The high Ag content provides a low contact resistance and a good oxidation resistance. However, Ag is an expensive material, has a low resistance against arc erosion and is relatively weak, particularly when compared to WC. Therefore, conventional contacts for low voltage circuit breakers are cost intensive to manufacture and have only a reduced life time.

SUMMARY

The above-mentioned shortcomings, disadvantages and problems are addressed herein which will be understood by reading and understanding the following specification. Specifically, the present disclosure outlines a cost efficient and reliable contact for a low voltage circuit breaker.

According to an aspect, a low voltage circuit breaker is provided. The low voltage circuit breaker includes a contact system with a first contact and a second contact that are electrically connectable and disconnectable relative to one another. The first contact includes a body having a first layer and a second layer, wherein the first layer is arranged on the second layer and is configured to come in contact with the second contact for providing the electrical connection with the second contact. The first layer has a first material composition having an Ag content that is higher than an Ag content of a second material composition of the second layer. Further, the first material composition has a WC content that is lower than a WC content of the second material composition.

According to embodiments, the first layer can have a WC/Ag ratio of equal to or smaller than 80/20, specifically equal to or smaller than 50/50, particularly equal to or smaller than 40/60. Alternatively or additionally, the second layer can have a WC/Ag ratio of equal to or greater than 20/80, specifically equal to or greater than 50/50, particularly equal to or greater than 60/40.

According to embodiments, the first material composition can include, in mass-%, Ag: 30 to 80, W: 25 to 65, Ni: 0 to 40, Co: 0 to 40, Cu: 0 to 40, C: 1.5 to 5, Cr: 0 to 20, Mo 0 to 20, the balance being Fe and inevitable impurities, wherein Ag, W, Ni, Co, Cu, C, Cr and Mo are included in a total amount of at least 80%. According to embodiments, the first material composition can include, in mass-%, Cu: 0 to 20. Specifically, the first material composition can include, in mass-%, Ag: 40 to 65, W: 30 to 50, Ni: 0 to 10, Co: 0 to 10, Cu: 0 to 5, C: 2 to 3.5, the balance being Fe and inevitable impurities, wherein Ag, W, Ni, Co, Cu and C are included in a total amount of at least 96%.

According to embodiments, the second material composition can include, in mass-%, Ag: 20 to 70, W: 35 to 75, Ni: 0 to 40, Co: 0 to 40, Cu: 0 to 40, C: 2 to 5.5, Cr: 0 to 20, Mo 0 to 20, the balance being Fe and inevitable impurities, wherein Ag, W, Ni, Co, Cu, C, Cr and Mo are included in a total amount of at least 80%. According to embodiments, the second material composition can include, in mass-%, Cu: 0 to 20. Specifically, the second material composition can include, in mass-%, Ag: 35 to 75, W: 40 to 60, Ni: 0 to 10, Co: 0 to 10, Cu: 0 to 5, C: 2.5 to 4.5, the balance being Fe and inevitable impurities, wherein Ag, W, Ni, Co, Cu and C are included in a total amount of at least 96%.

According to embodiments, the first layer can have a first conductivity that is higher than a second conductivity of the second layer. In particular, first conductivity can be equal to or greater than 10 MS/m, specifically equal to or greater than 15 MS/m and/or equal to or smaller than 35 MS/m, specifically equal to or smaller than 20 MS/m. Alternatively or additionally, the second conductivity can be equal to or greater than 5 MS/m, specifically equal to or greater than 8 MS/m and/or equal to or smaller than 30 MS/m, specifically equal to or smaller than 20 MS/m.

According to embodiments, the first layer can have a first hardness that is smaller than a second hardness. The first hardness and the second hardness can be determined and/or measured by the Vickers HV1 hardness testing method according to Standard ISO 6507-1. In particular, the first hardness can be equal to or greater than 130 HV1 and/or equal to or smaller than 200 HV1. Alternatively or additionally, the second hardness can be equal to or greater than 150 HV1, specifically equal to or greater than 180 HV1 and/or equal to or smaller than 600 HV1, specifically equal to or smaller than 500 HV1.

According to embodiments, the first layer can have a first thickness being equal to or greater than 3% of a body thickness of the body, specifically equal to or greater than 10% of the body thickness and/or equal to or smaller than 75% of the body thickness.

According to embodiments, the first layer and the second layer can make up at least 80 mass-% of the body.

According to embodiments, the body further can include a transition zone between the first layer and the second layer. An Ag content of the transition zone can be gradually changed from the Ag content of the first layer to the Ag content of the second layer. Alternatively or additionally, a WC content of the transition zone can be gradually changed from the WC content of the first layer to the WC content of the second layer.

According to embodiments, a rated number of switching operations of the low voltage circuit breaker at a rated nominal current can be equal to or smaller than 20000. In particular, a rated number of switching operations of the low voltage circuit breaker at a rated nominal current can be up to 20000.

According to embodiments, the low voltage circuit breaker can be rated for a rated voltage of equal to or greater than 100 V, and/or equal to or smaller than 1200 V, specifically equal to or smaller than 690 V.

According to embodiments, the low voltage circuit breaker can be rated for a current of equal to or greater than 10 A, specifically equal to or greater than 16 A and/or equal to or smaller than 12000 A, specifically equal to or smaller than 6300 A.

According to embodiments, the low voltage circuit breaker can be rated for a short circuit current of equal to or greater than 0.4 kA, specifically equal to or greater than 1 kA and/or equal to or smaller than 400 kA, specifically equal to or smaller than 200 kA.

According to embodiments, the second contact can have a third conductivity being higher than a common conductivity of the body of the first contact. Alternatively or additionally, the second contact can have a third hardness being lower than a common hardness of the body of the first contact.

According to embodiments, the first contact can be attached to a carrier. Further, the carrier can be configured to be rotated about an axis, e.g. for selectively providing and breaking an electrical connection with the second contact. Accordingly, the first contact can be configured to be rotated about an axis, e.g. for selectively providing and breaking an electrical connection with the second contact.

According to embodiments, wherein the first layer and the second layer can be formed by a powder metallurgical process such as sintering.

Embodiments are also directed at apparatuses for carrying out the disclosed methods and include apparatus parts for performing each described method aspect. These method aspects may be performed by way of hardware components, a computer programmed by appropriate software, by any combination of the two or in any other manner. Furthermore, embodiments according to the disclosure are also directed at methods for operating the described apparatus. The methods for operating the described apparatus include method aspects for carrying out functions of the apparatus.

BRIEF DESCRIPTION OF THE DRAWINGS

So that the manner in which the above recited features of the present disclosure can be understood in detail, a more particular description of the disclosure, briefly summarized above, may be had by reference to embodiments. The accompanying drawings relate to embodiments of the disclosure and are described in the following.

DETAILED DESCRIPTION OF EMBODIMENTS

Reference will now be made in detail to the various embodiments of the disclosure, one or more examples of which are illustrated in the figures. Within the following description of the drawings, the same reference numbers refer to same components. Typically, only the differences with respect to individual embodiments are described. Each example is provided by way of explanation of the disclosure and is not meant as a limitation of the disclosure. Further, features illustrated or described as part of one embodiment can be used on or in conjunction with other embodiments to yield yet a further embodiment. It is intended that the description includes such modifications and variations. Unless otherwise stated herein, a percentage for a specific element in a chemical composition shall refer to a mass percentage of that element in the chemical composition.

Figure 1:
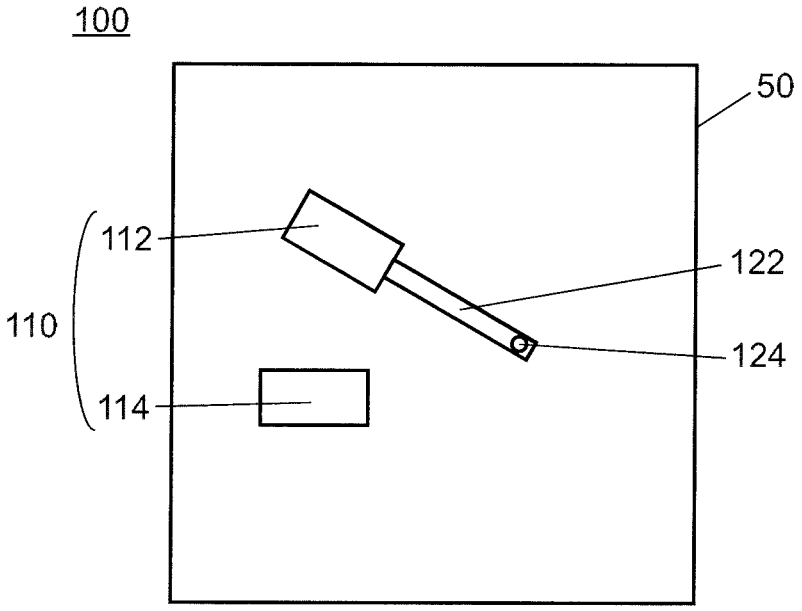
FIG. 1 shows a schematic view of a low voltage circuit breaker in a disconnected state.
Figure 2:
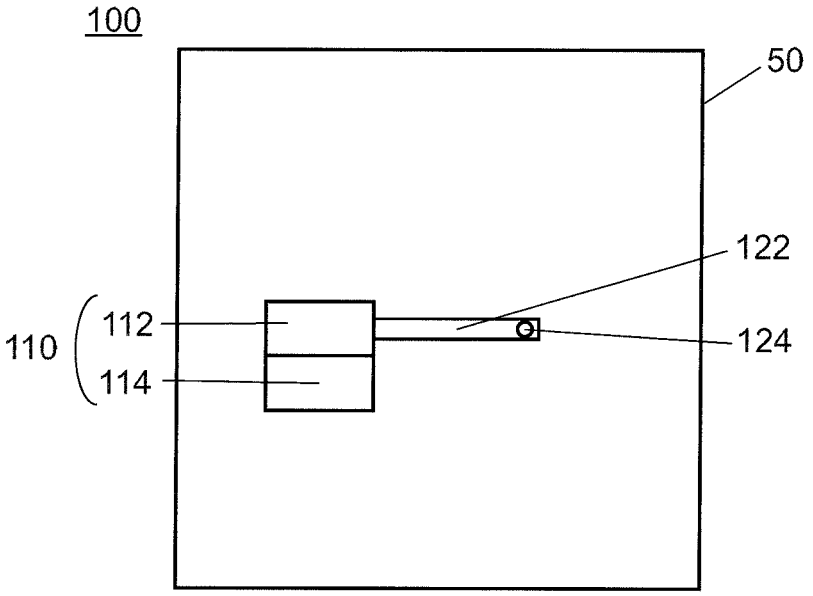
FIG. 2 shows a schematic view of a low voltage circuit breaker in a connected state.

FIGS. 1 and 2 show a low voltage circuit breaker 100. The low voltage circuit breaker 100 can be an automatically operated electrical switch, specifically designed and configured to protect an electrical circuit from damage caused by excess current, typically resulting from an overload or short circuit. Its basic function is to interrupt current flow after a fault is detected. Unlike a fuse, which operates once and then must be replaced, a circuit breaker can be reset (either manually or automatically) to resume normal operation. According to embodiments herein, the low voltage circuit breaker 100 can be configured for a rated number of switching operations at a rated nominal current of equal to or smaller than 20000. In particular, a rated number of switching operations of the low voltage circuit breaker at a rated nominal current can up to 20000. That is, the low voltage circuit breaker 100 can be rated for about 20000 switching operations.

In the context of the present disclosure, "low voltage" can be understood as being equal to or smaller than about 1200 V. According to embodiments described herein, the low voltage circuit breaker 100 can be rated for a rated voltage of equal to or greater than 100 V, and/or equal to or smaller than 1200 V, specifically equal to or smaller than 690 V. Additionally or alternatively, the low voltage circuit breaker 100 can be rated for a rated current of equal to or greater than 10 A, specifically equal to or greater than 16 A and/or equal to or smaller than 12000 A, specifically equal to or smaller than 6300 A. Additionally or alternatively, the low voltage circuit breaker 100 can be rated for a rated short circuit current of equal to or greater than 0.4 kA, specifically equal to or greater than 1 kA and/or equal to or smaller than 400 kA, specifically equal to or smaller than 200 kA.

The low voltage circuit breaker 100 can include a contact system 110. The contact system 110 can have a first contact 112 and/or a second contact 114. The first contact 112 and the second contact 114 can be electrically connectable and disconnectable relative to one another. Accordingly, the first contact 112 and the second contact 114 can be moved from a disconnected state as shown in FIG. 1 to a connected state as shown in FIG. 2. In the disconnected state, the first contact 112 and the second contact 114 are disconnected from each other and no electrical contact is formed between the first contact 112 and the second contact 114. In the connected state, the first contact 112 and the second contact 114 are connected and an electrical contact is formed between the first contact 112 and the second contact 114. Specifically, at least the first contact 112 can be movable for selectively providing and breaking the electrical connection with the second contact 114.

The first contact 112 can include a body b. The body b can have a first layer 11 and/or a second layer 12. The first layer 11 can be arranged on the second layer 12. Further, the first layer 11 can be configured to come in contact with the second contact 114 for providing an electrical connection with the second contact 114.

The first layer 11 can have a first material composition. The second layer 12 can have a second material composition. The first material composition can have an Ag content that is higher than an Ag content of the second material composition. Further, the first material composition can have a WC (tungsten carbide) content that is lower than a WC content of the second material composition.

As discussed herein, conventional contacts in low voltage circuit breakers are normally made of an AgWC material that includes, in mass-%, an Ag content of 60% and a WC content of 40%. The high Ag content provides a low contact resistance and a good oxidation resistance. However, Ag is an expensive material, exhibits low resistance against arc erosion and is relatively weak, particularly when compared to WC.

The present disclosure thus provides for the first layer 11, which is configured to come in contact with the second contact 114, a higher Ag content and a lower WC content as for the second layer 12. When practicing embodiments, a low contact resistance and a good oxidation resistance can be achieved, particularly at an interface with the second contact, while material cost can be saved.

Further, the second layer 12 can be provide an improved erosion resistance as compared to the conventional contact. When practicing embodiments, short circuit behavior of the low-voltage circuit breaker can be improved.

According to embodiments described herein, the first layer 11 can have a WC/Ag ratio of equal to or smaller than 80/20, specifically equal to or smaller than 50/50, particularly equal to or smaller than 40/60. Alternatively or additionally, the second layer 12 can have a WC/Ag ratio of equal to or greater than 20/80, specifically equal to or greater than 50/50, particularly equal to or greater than 60/40.

According to embodiments described herein, the first material composition can include, in mass-%, Ag: 30 to 80, W: 25 to 65, Ni: 0 to 40, Co: 0 to 40, Cu: 0 to 40, C: 1.5 to 5, Cr: 0 to 20, Mo 0 to 20, the balance being Fe and inevitable impurities, wherein Ag, W, Ni, Co, Cu, C, Cr and Mo are included in a total amount of at least 80%. According to embodiments described herein, the first material composition can include, in mass-%, Cu: 0 to 20. Specifically, the first material composition can include, in mass-%, Ag: 40 to 65, W: 30 to 50, Ni: 0 to 10, Co: 0 to 10, Cu: 0 to 5, C: 2 to 3.5, the balance being Fe and inevitable impurities, wherein Ag, W, Ni, Co, Cu and C are included in a total amount of at least 96%.

According to embodiments described herein, the second material composition can include, in mass-%, Ag: 20 to 70, W: 35 to 75, Ni: 0 to 40, Co: 0 to 40, Cu: 0 to 40, C: 2 to 5.5, Cr: 0 to 20, Mo 0 to 20, the balance being Fe and inevitable impurities, wherein Ag, W, Ni, Co, Cu, C, Cr and Mo are included in a total amount of at least 80%. According to embodiments described herein, the second material composition can include, in mass-%, Cu: 0 to 20. Specifically, the second material composition can include, in mass-%, Ag: 35 to 75, W: 40 to 60, Ni: 0 to 10, Co: 0 to 10, Cu: 0 to 5, C: 2.5 to 4.5, the balance being Fe and inevitable impurities, wherein Ag, W, Ni, Co, Cu and C are included in a total amount of at least 96%.

According to particular embodiments, substantially the whole C content and W content of the first material composition and the second material composition can be formed as WC (tungsten carbide). Accordingly, the amounts of C and W in the first material composition and the second material composition can correspond each other in a 1:1 relationship on a level of the individual atoms. As W has a higher molecular weight as C, the mass-% in the respective material compositions is higher for W than for C (about 15.3 times higher).

Taking the above considerations into account, the first material composition can include, in mass-%, Ag: 30 to 80, WC: 26.5 to 70, Ni: 0 to 40, Co: 0 to 40, Cu: 0 to 40, Cr: 0 to 20, Mo 0 to 20, the balance being Fe and inevitable impurities, wherein Ag, W, Ni, Co, Cu, C, Cr and Mo are included in a total amount of at least 80%. According to embodiments described herein, the first material composition can include, in mass-%, Cu: 0 to 20. Specifically, the first material composition can include, in mass-%, Ag: 40 to 65, W: 32 to 53.5, Ni: 0 to 10, Co: 0 to 10, Cu: 0 to 5, the balance being Fe and inevitable impurities, wherein Ag, W, Ni, Co, Cu and C are included in a total amount of at least 96%.

Further, the second material composition can include, in mass-%, Ag: 20 to 70, W: 37 to 80.5, Ni: 0 to 40, Co: 0 to 40, Cu: 0 to 40, Cr: 0 to 20, Mo 0 to 20, the balance being Fe and inevitable impurities, wherein Ag, W, Ni, Co, Cu, C, Cr and Mo are included in a total amount of at least 80%. According to embodiments described herein, the second material composition can include, in mass-%, Cu: 0 to 20. Specifically, the second material composition can include, in mass-%, Ag: 35 to 75, W: 42.5 to 64.5, Ni: 0 to 10, Co: 0 to 10, Cu: 0 to 5, the balance being Fe and inevitable impurities, wherein Ag, W, Ni, Co, Cu and C are included in a total amount of at least 96%.

As shown in FIGS. 1 and 2, the low voltage circuit breaker 100 can include a housing 50. The housing 50 can be configured for housing elements of the low voltage circuit breaker 100, such as the first contact 112 and the second contact 114. Further, the low voltage circuit breaker 100 can include mechanism to bias the first contact 112 when in the connected state. By biasing the first contact 112 when in connected state, the first contact 112 can be removed reliably and with high speed in a controlled manner from the second contact 114 upon release of the first contact 112.

According to embodiments described herein, wherein the first contact 112 can be attached to a carrier 122. The carrier 122 can be configured to be rotated about an axis. For instance, the first contact 112 can be attached to the carrier 122 at a first end of the carrier 122. The carrier 122 can be connected at the second end opposite to the first end to a hinge 124. The hinge 124 can be connected to the axis for rotating the carrier 122 around the axis.

Figure 3:
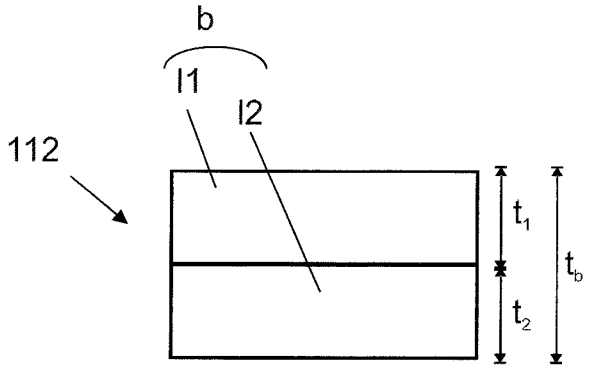
FIG. 3 shows a schematic view of a first contact of a low voltage circuit breaker.

FIG. 3 shows the first contact 112 in more detail. The body b can have a body thickness $t_b$. The first layer l1 can have a first thickness $t_1$. The second layer l2 can have a second thickness $t_2$. According to embodiments described herein, the first thickness $t_1$ can be equal to or greater than 3% of the body thickness $t_b$, specifically equal to or greater than 10% of the body thickness $t_b$ and/or being equal to or smaller than 75% of the body thickness $t_b$.

According to embodiments, the first layer l1 and the second layer make up at least 80 mass-% of the body b. In particular embodiments, the first layer l1 and the second layer l2 make up substantially the whole body b. In the latter case, the difference between the body thickness $t_b$ and the first thickness $t_1$ can be the second thickness $t_2$. In cases where the first layer l1 and the second layer l2 do not make up the whole body b, the sum of the first thickness $t_1$ and the second thickness $t_2$ can be smaller than the body thickness $t_b$.

Figure 4:
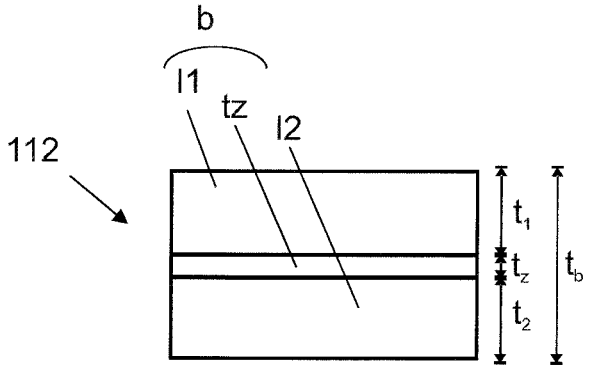
FIG. 4 shows a schematic view of a first contact of a low voltage circuit breaker.

As shown in FIG. 4, the body b can further include a transition zone tz between the first layer l1 and the second layer l2. An Ag content of the transition zone tz can be gradually changed from the Ag content of the first layer l1 to the Ag content of the second layer l2. Alternatively or additionally, a WC content of the transition zone tz can be gradually changed from the WC content of the first layer l1 to the WC content of the second layer l2. The transition zone tz can make up of at least 5%, specifically at least 10%, particularly at least 25% of the sum of the first thickness $t_1$ and the second thickness $t_2$.

According to embodiments described herein, the transition zone tz can make up substantially the whole first layer 11 and the second layer l2. Accordingly, in this case, the first layer l1 and the second layer l2 can be considered as sub-layers of the transition zone tz that undergo a gradual change of the Ag content and the WC content from a beginning of the first layer l1 to an end of the second layer l2.

Furthermore, also not explicitly shown in the figures, a top layer can be formed on the first layer l1. The top layer can have an even higher Ag content as the first layer l1. When practicing embodiments, a contact resistance at a surface of the first contact 112 can be further decreased.

According to embodiments described, the body b can essentially consist of the first layer l1, the second layer l2 and optionally the transition zone tz. The term "essentially consist of" can be understood in this context as meaning that no further layer is added intentionally to the body b. However, layers that are added to the body due to constraints of the manufacturing process can also be encompassed by this term.

According to embodiments described therein, the first layer l1 and/or the second layer l2, and/or optionally the transition zone tz, can be formed by a powder metallurgical process such as sintering.

Figure 5:
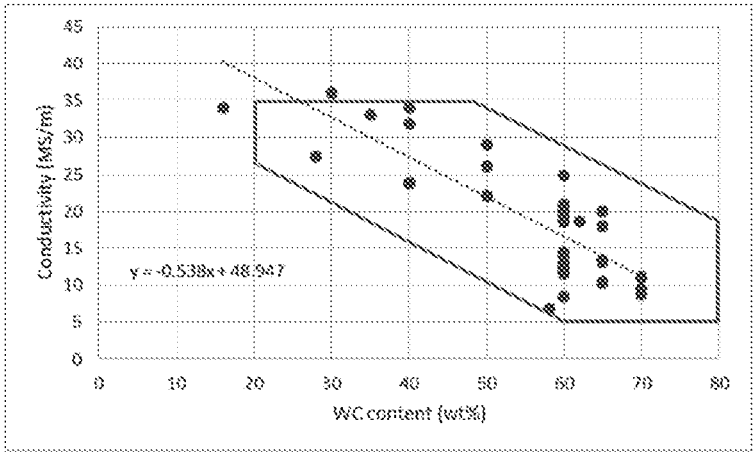
FIG. 5 shows a graph illustrating a dependence of a conductivity on a WC content.

FIG. 5 shows a graph illustrating a dependence of a conductivity on a WC content.

According to embodiments described herein, the first layer l1 can have a first conductivity $\sigma_1$. The second layer l2 can have a second conductivity $\sigma_2$. The first conductivity $\sigma_1$ can be higher than second conductivity $\sigma_2$. Specifically, the first conductivity $\sigma_1$ can be equal to or greater than 10 MS/m, specifically equal to or greater than 15 MS/m and/or equal to or smaller than 35 MS/m, specifically equal to or smaller than 20 MS/m. Alternatively or additionally, the second conductivity $\sigma_2$ can be equal to or greater than 5 MS/m, specifically equal to or greater than 8 MS/m and/or equal to or smaller than 30 MS/m, specifically equal to or smaller than 20 MS/m.

The first conductivity $\sigma_1$ can depend on the WC content of the first material composition and/or the second conductivity $\sigma_2$ can depend on the WC content of the second material composition. In particular, the first conductivity $\sigma_1$ can depend on the WC content of the first material composition in an inverse manner and/or the second conductivity $\sigma_2$ can depend on the WC content of the second material composition in an inverse manner. That is, the higher the WC content in the first material composition and/or the second material composition is, the lower the first conductivity $\sigma_1$ and the second conductivity $\sigma_2$, respectively, can get.

As illustrated in FIG. 5, the dependence of first conductivity $\sigma_1$ and/or the second conductivity $\sigma_2$ on the WC content of the first material composition and the second material composition, respectively, can be described by the following formulas (1) and (2):

$$\sigma_1,\sigma_2 \geq (-0.54 \times \text{WC content})\text{MS/m}\cdot\text{mass-\%}+37\ \text{MS/m} \quad (1);$$

and $$\sigma_1,\sigma_2 \leq (-0.54 \times \text{WC content})\text{MS/m}\cdot\text{mass-\%}+60\ \text{MS/m} \quad (2).$$

According to embodiments described herein, the second contact 114 can have a third conductivity $\sigma_3$ being higher than a common conductivity $\sigma_b$ of the body b of the first contact 112. The common conductivity $\sigma_b$ of the body b can be the overall conductivity of the body b. In the case where the body includes only the first layer l1 and the second layer l2 the common conductivity $\sigma_b$ of the body b can be a mean value of the first conductivity $\sigma_1$ and the second conductivity $\sigma_2$.

Figure 6:
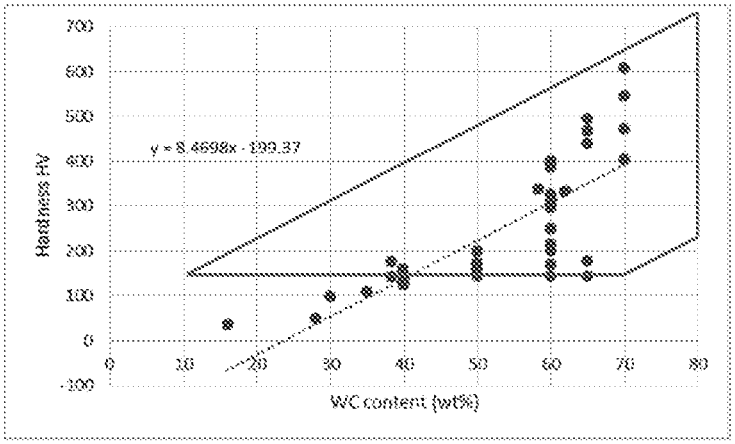
FIG. 6 shows a graph illustrating a dependence of a hardness on a WC content.

FIG. 6 shows a graph illustrating a dependence of a hardness on a WC content. A hardness referred to herein can be determined and/or measured by the Vickers HV1 hardness testing method according to Standard ISO 6507-1. Accordingly, all values of hardness described herein can be values determined and/or measured by the Vickers HV1 hardness testing method according to Standard ISO 6507-1.

According to embodiments described herein, the first layer l1 can have a first hardness $H_1$. The second layer l2 can have a second hardness $H_2$. The first hardness $H_1$ can be smaller than the second hardness $H_2$. Specifically, the first hardness $H_1$ can be equal to or greater than 130 HV1 and/or equal to or smaller than 200 HV1. Alternatively or additionally, the second hardness $H_2$ can be equal to or greater than 150 HV1, specifically equal to or greater than 180 HV1 and/or equal to or smaller than 600 HV1, specifically equal to or smaller than 500 HV1.

The first hardness $H_1$ can depend on the WC content of the first material composition and/or the second hardness $H_2$ can depend on the WC content of the second material composition. In particular, the first hardness $H_1$ can depend on the WC content of the first material composition in a proportional manner and/or the second hardness $H_2$ can depend on the WC content of the second material composition in a proportional manner. That is, the higher the WC content in the first material composition and/or the second material composition is, the higher the first hardness $H_1$ and the second hardness $H_2$, respectively, can get.

As illustrated in FIG. 6, the dependence of first hardness $H_1$ and/or the second hardness $H_2$ on the WC content of the first material composition and the second material composition, respectively, can be described by the following formulas (3) and (4):

$$H_1,H_2 \geq (8.5 \times \text{WC content})\text{HV1/mass-\%}-350\text{HV1} \quad (3);$$

and $$H_1,H_2 \leq (8.5 \times \text{WC content})\text{HV1/mass-\%}+50\ \text{HV1} \quad (4).$$

According to embodiments described herein, the second contact 114 can have a third hardness $H_3$ being lower than a common hardness $H_b$ of the body b of the first contact 112. The common hardness $H_b$ of the body b can be the overall hardness of the body b. In the case where the body includes only the first layer l1 and the second layer l2 the common hardness $H_b$ of the body b can be a mean value of the first hardness $H_1$ and the second hardness $H_2$. Further, also the third hardness $H_3$ can depend on a WC content of a third material composition of the second contact 114 in the manner as described for the first hardness $H_1$ and/or the second hardness $H_2$.

A comparative example may have a first contact that is made of an AgWC material having an Ag content of 60 mass-%. The first contact element of the comparative example may have a weight of about 0.7 g. Accordingly, the first contact element of the comparative example can have a Ag content having a mass of 0.42 g. The first contact of the comparative example can have a volume of about 0.0558 $cm^3$.

An example according to the present disclosure may have a first contact 112 including layer l1 having a Ag content of 60 mass-% and a WC content of 40 mass-% and a second layer l2 having a Ag content of 40 mass-% and a WC content of 60 mass-%. The first layer l1 and the second layer l2 can have the same thickness, i.e. $t_1=t_2$. Further the first contact 112 according to the example can have the same volume as the first contact of the comparative example. Accordingly, in this example, the first layer l1 has an Ag content having a mass of 0.21 g and the second layer l2 has a Ag content having a mass of 0.151 g. That is, the first contact of this example has in total a Ag content having a total mass of 0.361 g, corresponding to save of 14% of mass of a Ag as compared to the comparative example.

The invention claimed is:

1. A low voltage circuit breaker, comprising:

a contact system with a first contact and a second contact that are electrically connectable and disconnectable relative to one another, wherein the first contact includes a body having a first layer and a second layer, wherein the first layer is arranged on the second layer and is positioned to contact with the second contact for providing the electrical connection with the second contact, the first layer and the second layer being on opposing ends of the body, wherein the first layer has a first material composition having an Ag content that is higher than an Ag content of a second material composition of the second layer, and wherein the first material composition has a WC content that is lower than a WC content of the second material composition, the WC content increasing from the first end to the second end such that the WC content at the second end of the body is larger than the WC content in the remainder of the body, wherein the body further includes a transition zone (tz) between the first layer and the second layer, wherein a WC content of the transition zone (tz) is gradually changed from the WC content of the first layer to the WC content of the second layer, wherein the first layer has a WC/Ag content ratio equal to, or smaller than, 40/60, the composition of the first layer including, in mass-%, at least 25% W and at least 1.5% C, and wherein the second layer has a WC/Ag content ratio equal to, or greater than, 60/40, the composition of the second layer including, in mass-%, at least 20% Ag.

2. A low voltage circuit breaker, comprising:

a first contact mounted to a carrier and extending between a first end and a second end of the body, the first end positioned to, via displacement of the carrier, contact a second contact of the low voltage circuit breaker, the body further comprising;

a first layer having a first composition along the first end that includes both an Ag content and a WC content, and a second layer having a second composition along the second end that includes both an Ag content and a WC content, wherein the Ag content of the first composition is greater, in mass-%, than the Ag content of the second composition, the second composition comprising, in mass-%, at least 20% Ag, and wherein the WC content of the second composition being larger, in mass-%, than the WC content of the first layer, the WC content increasing from the first end to the second end such that the WC content at the second end of the body is larger than the WC content in the remainder of the body, the first composition comprising, in mass-%, at least 26.5% WC, and wherein the first contact has a first common conductivity based on a mean value of a first conductivity $\sigma_1$ of the first layer and a second conductivity $\sigma_2$ of the second layer, the first common conductivity of the first contact being different than a second common conductivity of the second contact.

3. A low voltage circuit breaker, comprising:

a contact system with a first contact and a second contact that are electrically connectable and disconnectable relative to one another, wherein the first contact includes a body having a first layer and a second layer, wherein the first layer is arranged on the second layer and positioned to contact the second contact for providing the electrical connection with the second contact, wherein the first layer has a first material composition having both an Ag content and a WC content, and the second layer having a second material composition having both an Ag content and an WC content, the Ag content of the first material composition being higher than the Ag content of the second material composition of the second layer, and wherein the WC content of the first material composition is lower than the WC content of the second material composition, the first layer and the second layer positioned on opposing first and second ends of the body, the WC content increasing from the first end to the second end such that the WC content at the second end of the body is larger than the WC content in the remainder of the body, and wherein the Ag content at the first end of the body where the first layer contacts the second contact is higher than the Ag content at the opposing second end of the body, wherein the first material composition includes, in mass-%, Ag: 30 to 80, W: 25 to 65, Ni: 0 to 40, Co: 0 to 40, Cu: 0 to 40, C: 1.5 to 5, Cr: 0 to 20, Mo 0 to 20, the balance being Fe and inevitable impurities, wherein Ag, W, Ni, Co, Cu, C, Cr and Mo are included in a total amount of at least 80%, and wherein the second material composition comprises, in mass-%, Ag: 20 to 70.

4. The low voltage circuit breaker according to claim 3, wherein the second material composition further includes, in mass-%, W: 35 to 75, Ni: 0 to 40, Cu: 0 to 40, C: 2 to 5.5, Cr: 0 to 20, Mo 0 to 20, the balance being Fe and inevitable impurities, wherein Ag, W, Ni, Co, Cu, C, Cr and Mo are included in a total amount of at least 80%.

5. The low voltage circuit breaker according to claim 3, wherein the first layer has a first conductivity $\sigma_1$ that is higher than a second conductivity $\sigma_2$ of the second layer, the first contact having a first common conductivity based on a mean value of the first conductivity $\sigma_1$ and the second conductivity $\sigma_2$, the first common conductivity of the first contact being different than a second common conductivity of the second contact.

6. The low voltage circuit breaker according to claim 5, wherein the first conductivity $\sigma_1$ is equal to or greater than 10 MS/m, and/or the second conductivity $\sigma_2$ is equal to or greater than 5 MS/m.

7. The low voltage circuit breaker according to claim 5, wherein the first conductivity $\sigma_1$ is equal to or smaller than 20 MS/m, and/or the second conductivity $\sigma_2$ is equal to or smaller than 20 MS/m.

8. The low voltage circuit breaker according to claim 3, wherein the first layer has a first hardness $H_1$ that is smaller than a second hardness $H_2$ of the second layer, the first contact having a first common hardness based on a mean value of the first hardness $H_1$ and the second hardness $H_2$, the first common hardness of the first contact being different than a second common hardness of the second contact.

9. The low voltage circuit breaker according to claim 8, wherein the first hardness $H_1$ is equal to or greater than 130 HV1 and/or equal to or smaller than 200 HV1, and/or wherein the second hardness $H_2$ is equal to or greater than 150 HV1.

10. The low voltage circuit breaker according to claim 8, wherein the second hardness $H_2$ is equal to or greater than 180 HV1 and/or equal to or smaller than 600 HV1.

11. The low voltage circuit breaker according to claim 3, wherein the first layer has a first thickness ($t_l$) being equal to or greater than 3% of a body thickness ($t_b$) of the body (b).

12. The low voltage circuit breaker according to claim 3, wherein the first layer and the second layer make up at least 80 mass-% of the body (b).

13. The low voltage circuit breaker according to claim 3, wherein a rated number of switching operations of the low voltage circuit breaker at a rated nominal current is equal to or smaller than 20000.

14. The low voltage circuit breaker according to claim 3, wherein the low voltage circuit breaker is rated for a voltage of equal to or greater than 100 V, and/or equal to or smaller than 1200 V.

15. The low voltage circuit breaker according to claim 3, wherein the low voltage circuit breaker is rated for a current of equal to or greater than 10 A, specifically equal to or greater than 16 A and/or equal to or smaller than 12000 A, and/or wherein the low voltage circuit breaker is rated for a short circuit current of equal to or greater than 0.4 kA.

16. The low voltage circuit breaker according to claim 3, wherein the first contact is attached to a carrier, wherein the carrier is configured to be rotated about an axis.

17. The low voltage circuit breaker according to claim 3, wherein the first layer and the second layer have properties consistent with being formed by a powder metallurgical process such as sintering.

18. The low voltage circuit breaker according to claim 3, wherein the second material composition includes, in mass-%, Ag: 20 to 70, W: 35 to 75, Ni: 0 to 40, Co: 0 to 40, Cu: 0 to 40, C: 2 to 5.5, Cr: 0 to 20, Mo 0 to 20, the balance being Fe and inevitable impurities, wherein Ag, W, Ni, Co, Cu, C, Cr and Mo are included in a total amount of at least 80%.

19. The low voltage circuit breaker according to claim 3, wherein the first layer has a first thickness ($t_l$) being equal to or greater than 10% of the body thickness ($t_b$) and/or being equal to or smaller than 75% of the body thickness ($t_b$).

20. The low voltage circuit breaker according to claim 3, wherein the first layer has a first conductivity $\sigma_1$ that is higher than a second conductivity $\sigma_2$ of the second layer.

* * * * *